United States Patent [19]

Seidel

[11] 4,078,256

[45] Mar. 7, 1978

[54] INVERSION USING SUCCESSIVE APPROXIMATION

[75] Inventor: Harold Seidel, Warren, N.J.

[73] Assignee: Bell Telephone Laboratories, Incorporated, Murray Hill, N.J.

[21] Appl. No.: 777,636

[22] Filed: Mar. 15, 1977

[51] Int. Cl.[2] ..... G06G 7/26

[52] U.S. Cl. ..... 364/851; 307/229

[58] Field of Search ..... 235/193, 197, 196; 307/229, 230, 260, 262; 328/142, 161

[56] References Cited

U.S. PATENT DOCUMENTS

| | | | |
|---|---|---|---|
| 3,076,955 | 2/1963 | Huddleston, Jr. | 235/193 UX |
| 3,192,482 | 6/1965 | Long | 307/229 X |
| 3,230,395 | 1/1966 | Dortort | 235/197 UX |
| 3,573,443 | 4/1971 | Fein | 235/197 X |
| 3,987,366 | 10/1976 | Redman | 328/144 |

*Primary Examiner*—Joseph F. Ruggiero
*Attorney, Agent, or Firm*—Henry T. Brendzel

[57] ABSTRACT

Disclosed is a circuit for realizing an improved approximation to the inverse of a function, $f^{-1}$, which operates on an applied signal by means of a network for approximating the inverse function $f^{-1}$ and by means of a cascade interconnection of improvement blocks which successively improve the approximation.

4 Claims, 1 Drawing Figure

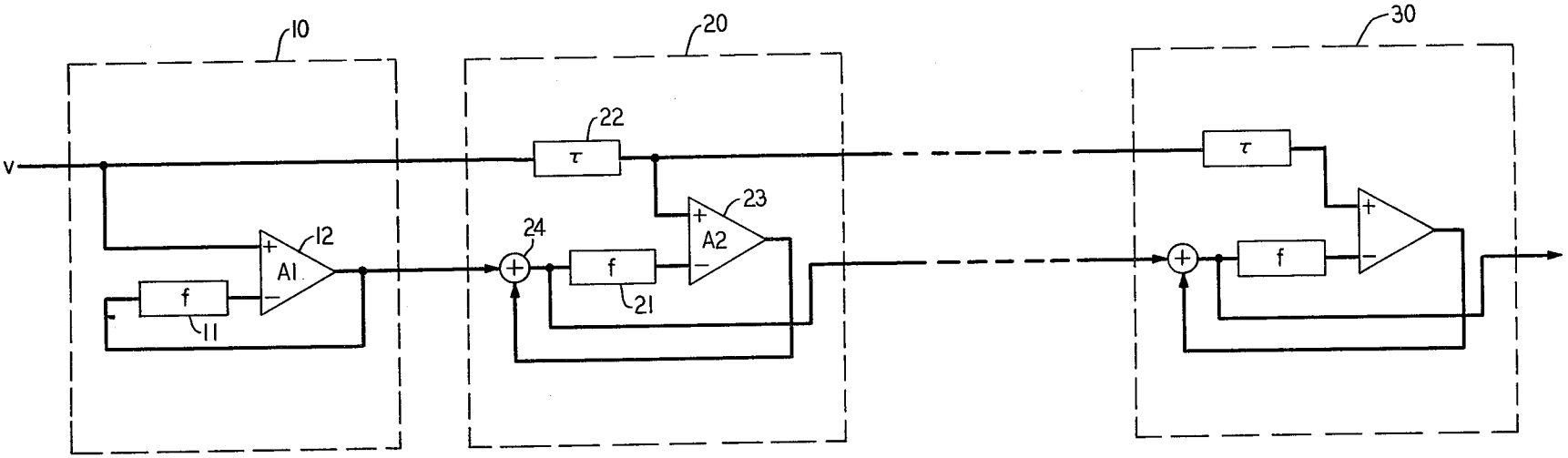
30
τ
f
20
22
τ
23
A2
21
f
24
10
12
A1
11
f
V

INVERSION USING SUCCESSIVE APPROXIMATION

BACKGROUND OF THE INVENTION

1. Field of the Invention

This invention relates to analog circuits and, more particularly, to circuits for realizing preselected functions.

2. Description of the Prior Art

Quite often it is desirable to obtain a signal that relates to a driving signal in accordance with a particular function. Such a signal is generally obtained by applying the driving signal to a device or a network which is adapted to develop the desired signal in response to the driving signal. A device or a network capable of responding in such a manner realizes, it is commonly said, the particular function. An amplifier, for example, realizes the linear function because the input signal relates to the output signal in essentially a linear fashion. Many other functions are commonly realizable through a combination of various nonlinear devices, as taught, for example, in *Wave Generation and Shaping* by L. Strauss, McGraw-Hill, 1960.

Sometimes it is the inverse of a function which is desired. In situations where it is easier to obtain the function itself rather than its inverse, feedback is generally employed to derive the desired inverse function.

Redman, U.S. Pat. No. 3,987,366, issued Oct. 19, 1976, describes one such feedback circuit where the square root function is derived. In accordance with Redman, an input signal whose square root is desired is applied to the positive input terminal of a differential amplifier while the output signal of the amplifier is fed back to the negative input terminal of the differential amplifier through a squaring device. Since the negative input of the amplifier is forced to closely approximate the input signal, the output of the amplifier (which is connected to the squaring device) is forced to approximate the square root of the input signal.

The feedback technique described by Redman is quite robust but it has one drawback; the accuracy of the inverse function is dependent on the amplifier's gain. For stability and noise immunity reasons it might not be desirable to employ amplifiers with very large gains. In such situations, accuracy is sacrificed.

SUMMARY OF THE INVENTION

It is an object of this invention to develop an approximation to the inverse of a function $f(v)$, where $v$ is the driving signal, i.e., to develop the inverse function $f^{-1}(v)$, without the use of large gain amplifiers.

It is another object of this invention to develop an approximation to the inverse function $f^{-1}(v)$ with an arbitrarily small error.

These and other objects of the invention are achieved by means of a circuit which approximates the inverse function $f^{-1}$ (where $f^{-1}$ is operating on an applied signal) and improves the approximation by means of a cascade interconnection of blocks which operate on the successively improved approximations. Successively better approximations are obtained in each recursive block by adding an error compensating signal to the previous approximation, by applying the new approximation to a block realizing the function $f$, and by comparing in a differential amplifier the output signal of the block realizing the function $f$ to the original input signal. The output signal of the amplifier serves as the aforesaid error compensating signal which is added to develop the improved approximation.

BRIEF DESCRIPTION OF THE DRAWING

In the drawing, the single FIGURE depicts a circuit employing the recursive approximation principles of this invention.

DETAILED DESCRIPTION

Block 10 in the FIG. is the basic prior art approximation block. It comprises a differential amplifier 12 having a differential gain A1 and a function element 11 which realizes the function $f$ whose inverse is sought to be obtained.

To develop the first approximation to the desired inverse function, the driving signal $v$ is applied to the positive input terminal of amplifier 12, the output of amplifier 12 is applied to the input terminal of element 11, and the output signal of element 11 is applied to the negative input terminal of amplifier 12. The approximation to the signal $f^{-1}(v)$ appears at the output, $e_{12}$, of amplifier 12, as is shown below. Since $$e_{12} = \mathbf{A1}(v - f(e_{12})) \tag{1}$$

$$f(e_{12}) + e_{12}/\mathbf{A1} = v \tag{2}$$

and $$f^{-1}[f(e_{12}) + e_{12}/\mathbf{A1}] = f^{-1}(v) \tag{3}$$

If A1 is sufficiently large to neglect the term $e_{12}/\mathbf{A1}$, then $$f^{-1}(f(e_{12})) = e_{12} = f^{-1}(v). \tag{4}$$

When A1 is not sufficiently large to neglect $3_{12}/\mathbf{A1}$, equation (3) may be rewritten as $$e_{12} + \epsilon_1 = f^{-1}(v) \tag{5}$$

or $$e_{12} = f^{-1}(v) - \epsilon_1 \tag{6}$$

where $\epsilon_1$ is the error in the approximation. This error, it can be seen from equation (3), relates to $e_{12}/\mathbf{A1}$, is small and is inversely proportional to A1.

Improvements in the approximation to the function $f^{-1}(v)$ are obtained, in accordance with the principles of this invention, by the use of recursive blocks which successively improve the approximation. In the Figure, only two of the recursive blocks are shown (blocks 20 and 30) but it should be realized that any number of blocks may similarly be employed. Blocks 20 and 30 are of identical construction. Therefore, only block 20 is described in detail herein.

To improve the approximation of the signal $e_{12}$ emanating from amplifier 12 which, as indicated above, approximates the signal $f^{-}(v)$, the signal $e_{12}$ is applied to an improving block 20 and, more particularly, to a first input of summing element 24 within block 20.

In addition to summing element 24, block 20 comprises a differential amplifier 23, a function circuit 21 for realizing the function $f$, and a delay element 22. The signal $v$ is connected to the input of delay element 22 while the output of delay element 22 is connected to the positive input terminal of amplifier 23. The output signal of summing element 24 is applied to the input terminal of function circuit 21 while the output terminal of function circuit 21 is connected to the negative input terminal of amplifier 23. The output signal of amplifier 23 is fed back to a second input of summing element 24.

Delay element 22 is designed to compensate for the delay incurred in the serial path comprising amplifier 12, summing element 24 and function circuit 21. Should there be no delay in elements 12, 24, and 21, delay element 22 would not be required. For purposes of the analysis below, the delay element shall be ignored.

In block 20, signal $e_{12}$ is added to the output signal of amplifier 23 and applied to function circuit 21. Designating the output signal of amplifier 23 by $\epsilon_2$, the input signal to function circuit 21 is $$f^{-1}(v) - \epsilon_1 + \epsilon_2 \tag{7}$$

The signal $\epsilon_2$ is a small signal, compensating for the error signal $\epsilon_1$. It may be asserted, therefore, that $\epsilon_2$ is of the same order of magnitude as $\epsilon_1$, and may be smaller. Thus, $\epsilon_2$ is at least inversely proportional to A1. Evaluating the error signal $\epsilon_2$, $$\epsilon_2 = \mathrm{A2}[v - f(f^{-1}(v) - \epsilon_1\,\epsilon_2)] \tag{8}$$

where A2 is the gain of amplifier 23. The closeness of the approximation obtained from the signal expressed by equation (7) may be evaluated with the aid of equation (8), to yield $$f^{-1}(v) - \epsilon_1 + \epsilon_2 = f^{-1}((v) - \epsilon_2/\mathrm{A2}) = f^{-1}(v) + \Psi \tag{9}$$

Equation (9) indicates that the approximation signal developed at the output of summing element 24 has an error signal $\Psi_2$ which is proportional to $\epsilon_2/\mathrm{A2}$. Since it is known that $\epsilon_2$ is small and at least inversely proportional to A1, it may be realized that the magnitude of the error signal $\Psi_2$ is inversely proportional to the product (A1)(A2). Thus $\Psi_2$ is smaller than $\epsilon_1$, and the approximation to $f^{-1}(v)$ obtained at the output of summing element 24 is improved over the approximation obtained at the output of amplifier 12.

The improved approximation signal developed in block 20 may still further be improved by connecting an additional improving block, identical to block 20, to the approximation signal output of block 20. The improving process may recursively be continued as far as desired. The recursive connection of improving blocks is shown in the Figure by the dotted connections to block 30.

What is claimed is:

1. A circuit for developing an improved approximation signal to the inverse of a preselected function operating on an applied signal, including a first differential amplifier for developing a first approximation signal responsive to said applied signal and to feedback means connected to an output terminal of said first amplifier, said feedback means realizing said preselected function, the improvement comprising:

a summing element responsive to said first approximation signal and to an error compensating signal for developing said improved approximation signal;

a network responsive to said improved approximation signal for realizing said preselected function;

a second differential amplifier for developing said error compensating signal;

means for connecting said network to a negative input of said second amplifier; and means for coupling said applied signal to a positive input of said second amplifier.

2. The circuit of claim 1 wherein said means for coupling comprises a delay element.

3. Apparatus for developing the inverse of a function operating on an applied signal including an approximation block for realizing an approximation to said inverse by negative feedback means and an improvement block comprising:

a summing element responsive to the output signal of said approximation block and to an error compensating signal for developing said inverse of a function;

a differential amplifier for developing said error compensating signal;

a network interposed between said summing element and the negative input of said differential amplifier for realizing said function; and means for coupling said applied signal to the positive input of said differential amplifier.

4. Apparatus for developing the inverse of a function operating on an applied signal including an approximation block and a cascade interconnection of improvement blocks, with the first improvement block being responsive to the output signal of said approximation block and each succeeding improvement block being responsive to the output signal of the respectively preceding improvement block, each improvement block comprising:

a summing element responsive to an error compensating signal and to the input signal to which said improvement block is responsive, for developing an output signal of said improvement block;

an amplifier for developing said error compensating signal;

a network for realizing said function interposed between said summing element and the negative input of said amplifier; and means for coupling said applied signal to the positive input of said differential amplifier.

* * * * *